US007663460B2

(12) United States Patent
Suzuki

(10) Patent No.: US 7,663,460 B2
(45) Date of Patent: Feb. 16, 2010

(54) PLANAR TRANSFORMER AND SWITCHING POWER SUPPLY

(75) Inventor: Nobuaki Suzuki, Tokyo (JP)

(73) Assignee: TDK Corporation, Tokyo (JP)

( * ) Notice: Subject to any disclaimer, the term of this patent is extended or adjusted under 35 U.S.C. 154(b) by 144 days.

(21) Appl. No.: 11/852,395

(22) Filed: Sep. 10, 2007

(65) Prior Publication Data

US 2008/0079524 A1 Apr. 3, 2008

(30) Foreign Application Priority Data

Sep. 29, 2006 (JP) ..... 2006-266848

(51) Int. Cl.
*H01F 27/08* (2006.01)

(52) U.S. Cl. ..... 336/61; 336/59; 336/60; 336/200; 336/232; 361/701; 361/702; 361/703; 361/704

(58) Field of Classification Search ..... 336/200, 336/232, 55–62; 361/748, 760, 678–688, 361/696–697, 700–704
See application file for complete search history.

(56) References Cited

U.S. PATENT DOCUMENTS 3,196,783 A * 7/1965 Gross ..... 101/109
4,413,674 A * 11/1983 Avery et al. ..... 165/104.33
4,873,757 A * 10/1989 Williams ..... 29/602.1
5,377,079 A * 12/1994 Morita et al. ..... 361/752
6,437,979 B1 * 8/2002 Unrein ..... 361/679.54
6,469,606 B1 10/2002 Tada et al.
2002/0184860 A1 * 12/2002 Sarles et al. ..... 53/478
2004/0257187 A1 * 12/2004 Drummond et al. ..... 336/61

FOREIGN PATENT DOCUMENTS

JP 62-112122 U 7/1987
JP 1-167010 U 11/1989
JP 2-56414 U 4/1990
JP 7-23559 A 1/1995
JP 7-288213 A 10/1995
JP 8-236365 A 9/1996
JP 11-195550 A 7/1999

OTHER PUBLICATIONS

English translation of Japanese Patent JP 7-23559.*

* cited by examiner

*Primary Examiner*—Anh T Mai
*Assistant Examiner*—Tszfung Chan
(74) *Attorney, Agent, or Firm*—Leydig, Voit & Mayer, Ltd.

(57) ABSTRACT

A planar transformer comprises a primary coil board including a primary coil, a secondary coil board including a secondary coil, a heat sink integrally having a spacer portion, and a magnetic core assembly mounted to the primary coil board and the secondary coil board. The spacer portion is inserted into a gap between and facing the primary coil board and the secondary coil board and at least a surface of the heat sink is electrical insulating.

9 Claims, 7 Drawing Sheets

10, 20 : Coil board 10, 20 : Coil board

PLANAR TRANSFORMER AND SWITCHING POWER SUPPLY

BACKGROUND OF THE INVENTION

1. Field of the Invention

This invention relates to planar transformers having a combination of primary coil board, a secondary coil board and a magnetic core assembly, to switching power supplies using the planar transformer, and more particularly to cooling structures thereof 2. Description of the Prior Art Recently, switching power supplies for electronic equipments were required to be decreased in size and thickness, thus planar transformers in which a primary coil and a secondary coil consisted of multilayer boards came to be used.

Conventional planar transformers using coils such as the multilayer boards have a structure to cool down coils indirectly by fixing a cooling fin on a magnetic core. For example, it is known a structure that is disclosed in Japanese Patent Application Laid-Open No. 7-23559.

However, increase of switching frequency in DC-DC converters used for switching power supplies accompanies with increase of eddy current losses of coils in planar transformers. There is a problem that said structure such as fixing the cooling fin on the magnetic core is less effective to cool down heat generations of coils themselves caused by eddy current losses.

Conventionally, transfer mold structures are known as methods for radiating heat generation from the primary coil and the secondary coil to ambient atmosphere. However, in case of planar transformers used for resonation type DC-DC converters in which a wide gap should be provided between primary and secondary coils, it is difficult to keep the wide gap constant when the transfer molding is made. If multilayer boards of the primary and secondary coils are integrally made, it seems to bring about many useless parts and to be adequate for cooling methods.

SUMMARY OF THE INVENTION

The present invention focuses attention on necessity of an appropriate gap between a primary coil board including a primary coil and a secondary coil board including a secondary coil in order to satisfy conditions of a leakage inductance, a coupling coefficient etc. in planar transformers used mainly for resonation type DC-DC converters. And then, an object of the present invention is to provide a planar transformer capable of effective cooling of the primary and secondary coils themselves by inserting a spacer portion of a heat sink into the gap and consequently capable of downsizing.

Another object of the present invention is to provide a switching power supply capable of downsizing by using the planar transformer.

Other objects as well as new features of the present invention will be clarified in embodiments to be described later.

A first embodiment of the invention is a planar transformer that comprises a primary coil board including a primary coil, a secondary coil board including a secondary coil, a heat sink and a magnetic core assembly. The heat sink integrally has a spacer portion inserted into a gap between the primary coil board and the secondary coil board facing each other and at least a surface of the heat sink is electrical insulation. The magnetic core assembly is mounted to the primary coil board and the secondary coil board.

In the planar transformer according to the embodiment, the primary coil board and the secondary coil board respectively include a multilayer board having conductive coil patterns formed on opposite surfaces and at least one inner layer of the multilayer board. An extend portion of the conductive coil pattern on the inner layer prolongs to a circumference side of the coil board so that the extend portion exposed to the circumference side contacts with the heat sink directly or through a high thermal conductive member.

In the planar transformer according to the embodiment, the primary coil board and the secondary coil board have an opening inside of the conductive coil pattern respectively, and a middle leg of the magnetic core assembly is inserted into the opening.

In the planar transformer according to the embodiment, the heat sink has plurality of cooling convexes or cooling concaves on an outer surface of the heat sink.

A second embodiment is a switching power supply that comprises a circuit board, and a planar transformer mounted on the circuit board. The planar transformer comprises a primary coil board including a primary coil, a secondary coil board including a secondary coil, a heat sink integrally having a spacer portion which inserted into a gap between the primary coil board and the secondary coil board facing each other and at least a surface of the heat sink is electrical insulation, and a magnetic core assembly mounted to the primary coil board and the secondary coil board.

In the switching power supply according to the second embodiment, the circuit board has a setting hole for positioning the primary coil board and the secondary coil board, and a fining convex portion of the primary and secondary coil boards is fitted to the setting hole.

In the switching power supply according to the second embodiment, the circuit board and the planar transformer are made integral by a mold resin body. The mold resin body may have plurality of cooling convexes or cooling concaves on an outer surface of the resin body.

DETAILED DESCRIPTION OF THE INVENTION

Figure 1:
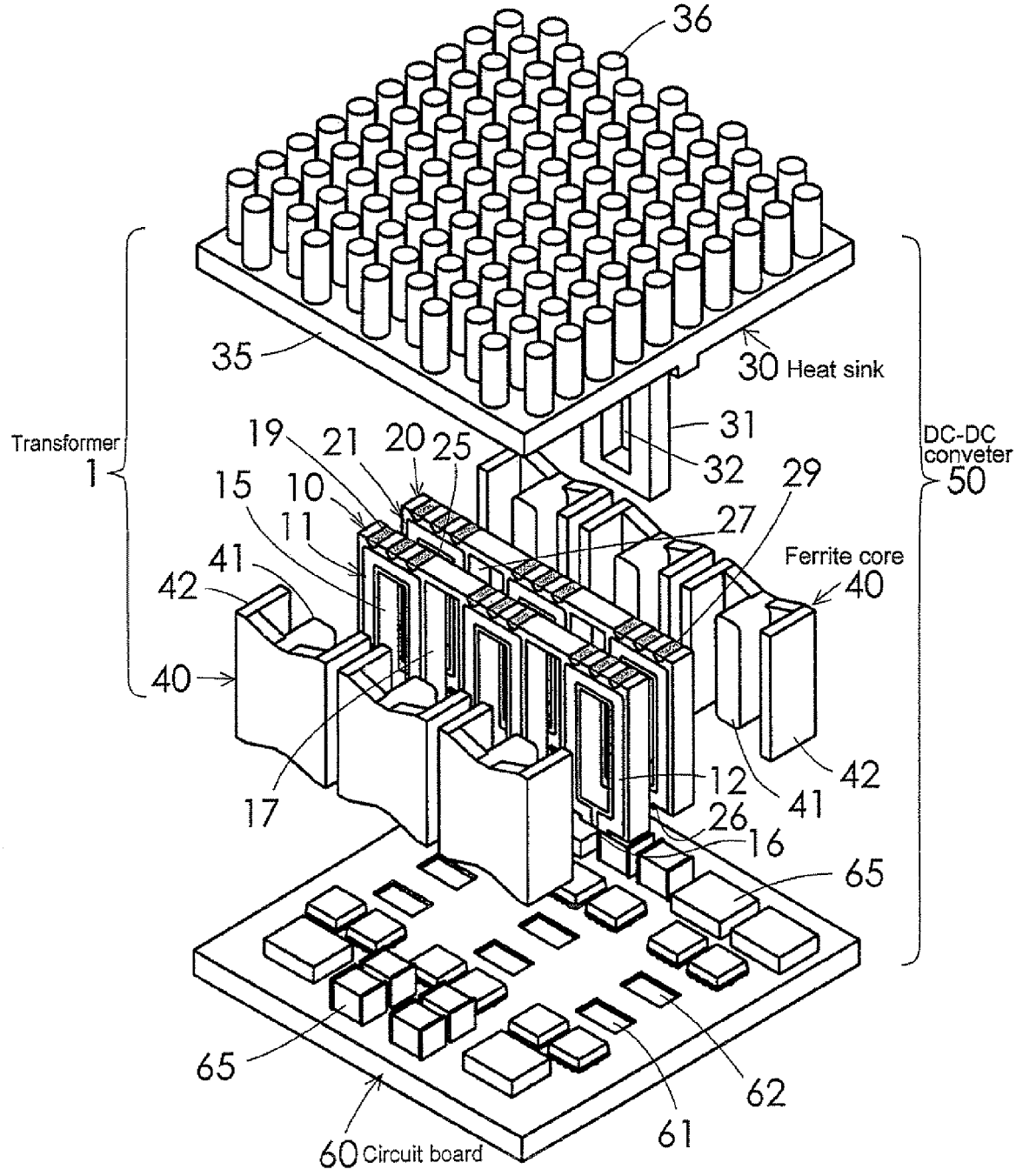
FIG. 1 shows an exploded perspective view of an embodiment of the planar transformer and the switching power supply.

Referring now to the drawings, an embodiment of the planar transformer and the switching power supply according to the invention is described.

As shown in FIG. 1 to FIGS. 6A, 6B and 6C a planar transformer 1 comprises a primary coil board 10 including a primary coil 11, a secondary coil board 20 including a secondary coil 21, a heat sink 30 integrally having a spacer portion 31 which is inserted into a gap between the primary coil board 10 and the secondary coil board 20, and a ferrite core assembly as a magnetic core assembly. The ferrite core assembly consists of pairs of ferrite cores 40 that surround the first and second coil boards 10 and 20.

A DC-DC converter 50 making up a switching power supply has a structure wherein the planar transformer 1 is mounted on a circuit board 60 on which a switching device switching a current flow through the primary coil 11 and a rectifier circuit rectifying a induced voltage of the secondary coil 21 of the planar transformer 1 are assembled.

Figure 7:
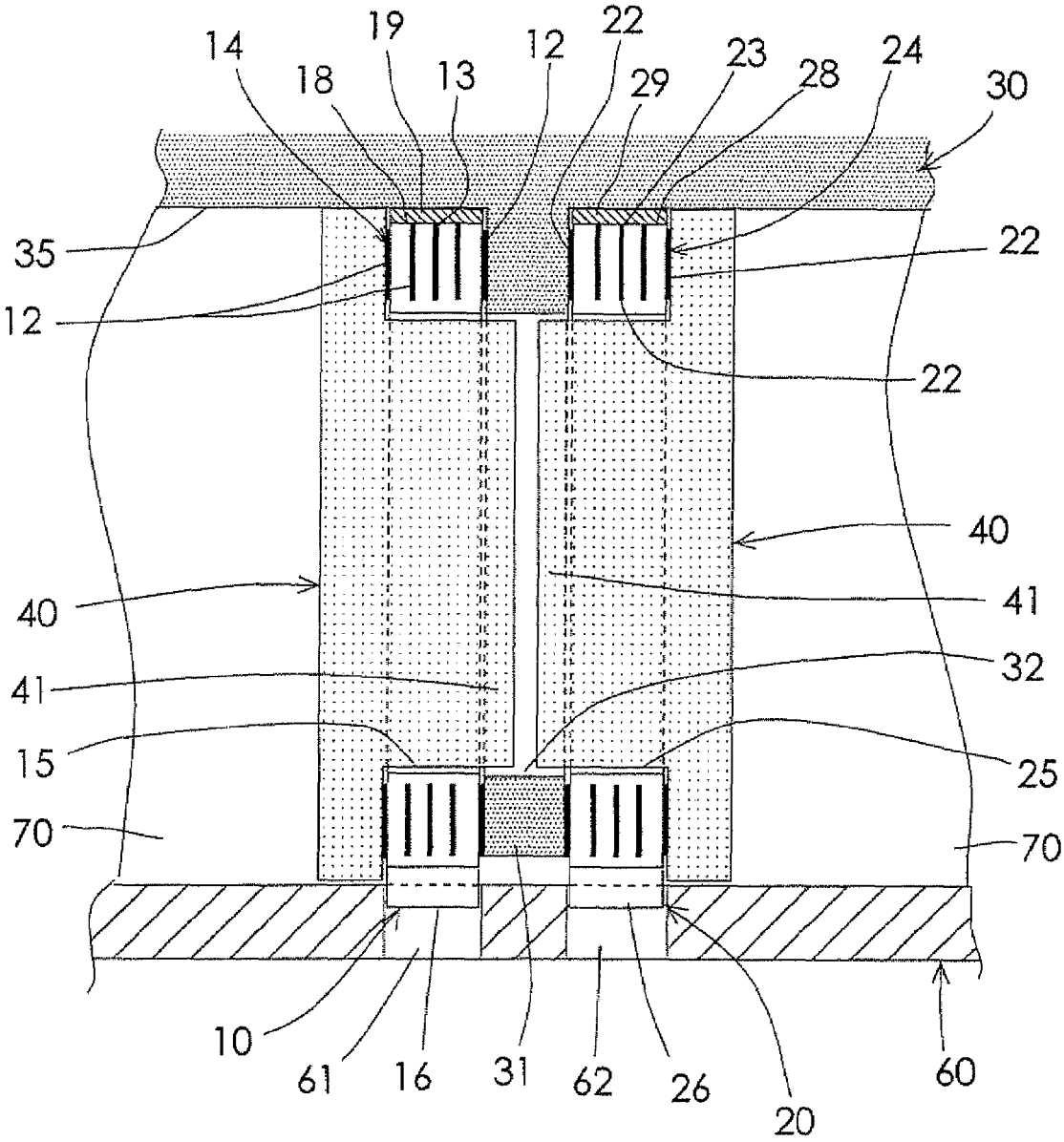
FIG. 7 shows a cross-sectional view of another cooling structure of the conductive coil patterns formed on inner layers belonging to the primary and secondary coil boards.

The primary coil board 10 is a multilayer board including conductive round coil patterns 12 (copper patterns etc.) formed respectively on opposite surfaces and intermediate layers (inner layers) of areas (for example, three areas in the drawings) of the multilayer board. As shown in FIG. 5, FIGS. 6A, 6B and 6C or FIG. 7, each extend portion 13 of the coil pattern 12 formed on the intermediate layers is prolonged to a circumference side (upper edge side) of the primary coil board 10, so that the extend portion 13 is exposed to a groove 18 of the circumference side for cooling. It is preferable that the extend portion 13 spreads out in a whole surface of the groove 18 as shown in FIG. 5, FIGS. 6A, 6B and 6C. Alternatively, the extend portion 13 may be partly exposed to the surface of the groove 18 at least as shown in FIG. 7. In FIG. 7, the same numerals are fixed to common members disclosed in FIG. 5.

Each conductive coil pattern 12 of the front side surface, the intermediate layers and the backside surface in each area of the primary coil board 10 is connected by throughholes (not shown) each other so as to make a coil part 14 of one turn or multiple turns around a opening (troughhole) 15. And, the coil parts 14 of all areas are connected in series by the circuit board 60 to make a primary coil 1. For example, the coil patterns 12 of the opposite surfaces and intermediate layers are connected each other by the extend portions 13 to make the coil part 14 of one turn as shown in FIG. 6, and all grooves 18 are filled with a high (good) thermal conductive resin 19 as a high thermal conductive member to make a flat surface.

Figure 5:
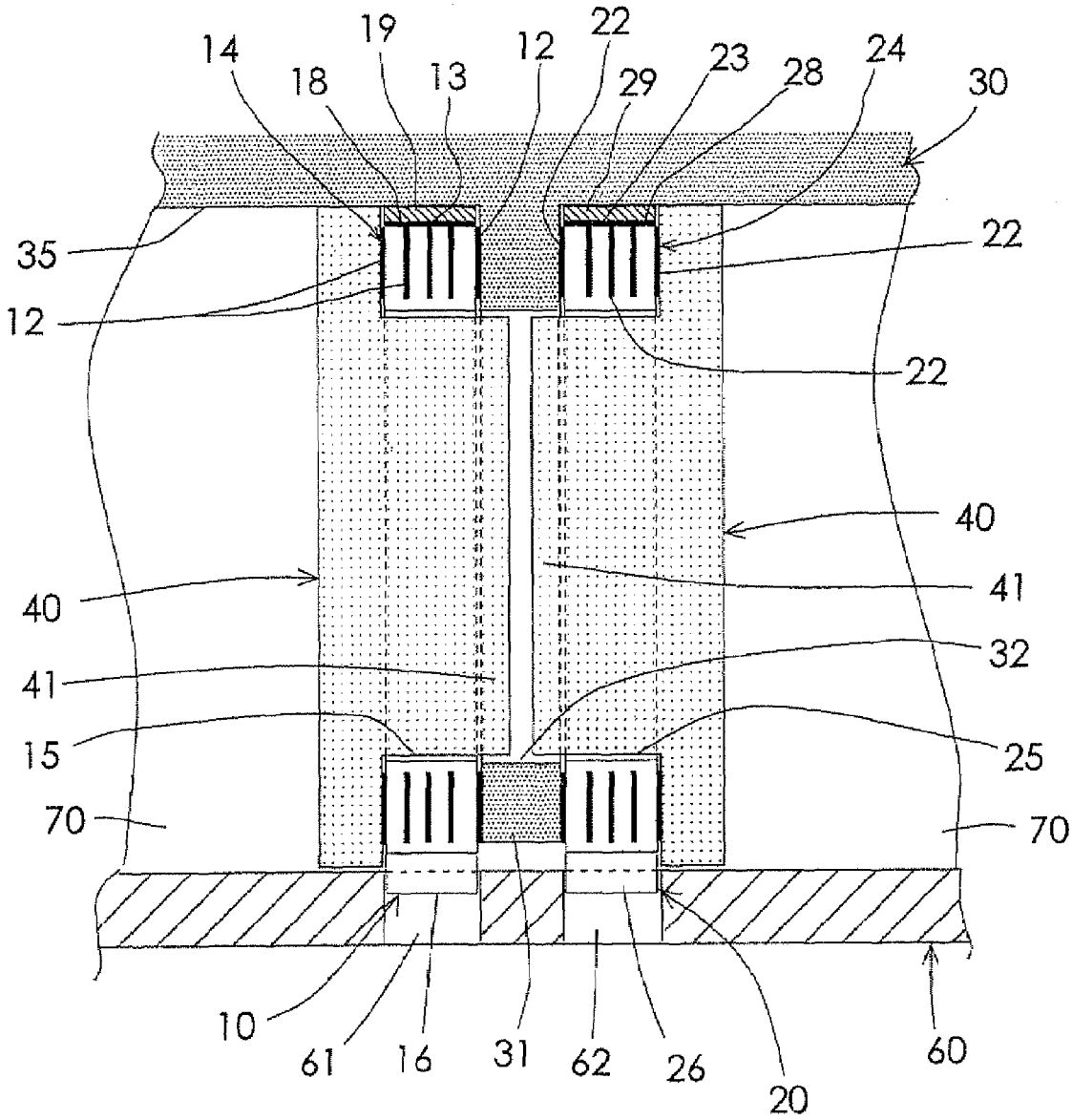
FIG. 5 shows a cross-sectional view of a cooling structure of conductive coil patterns formed on inner layers belonging to the primary and secondary coil boards in the embodiment.
Figure 6A:
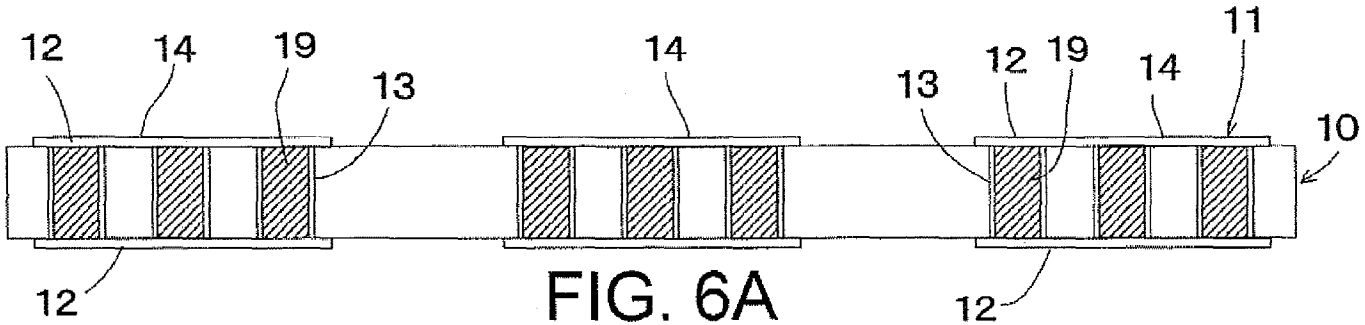
FIG. 6A shows a plan view of the coil board in the embodiment.
Figure 6B:
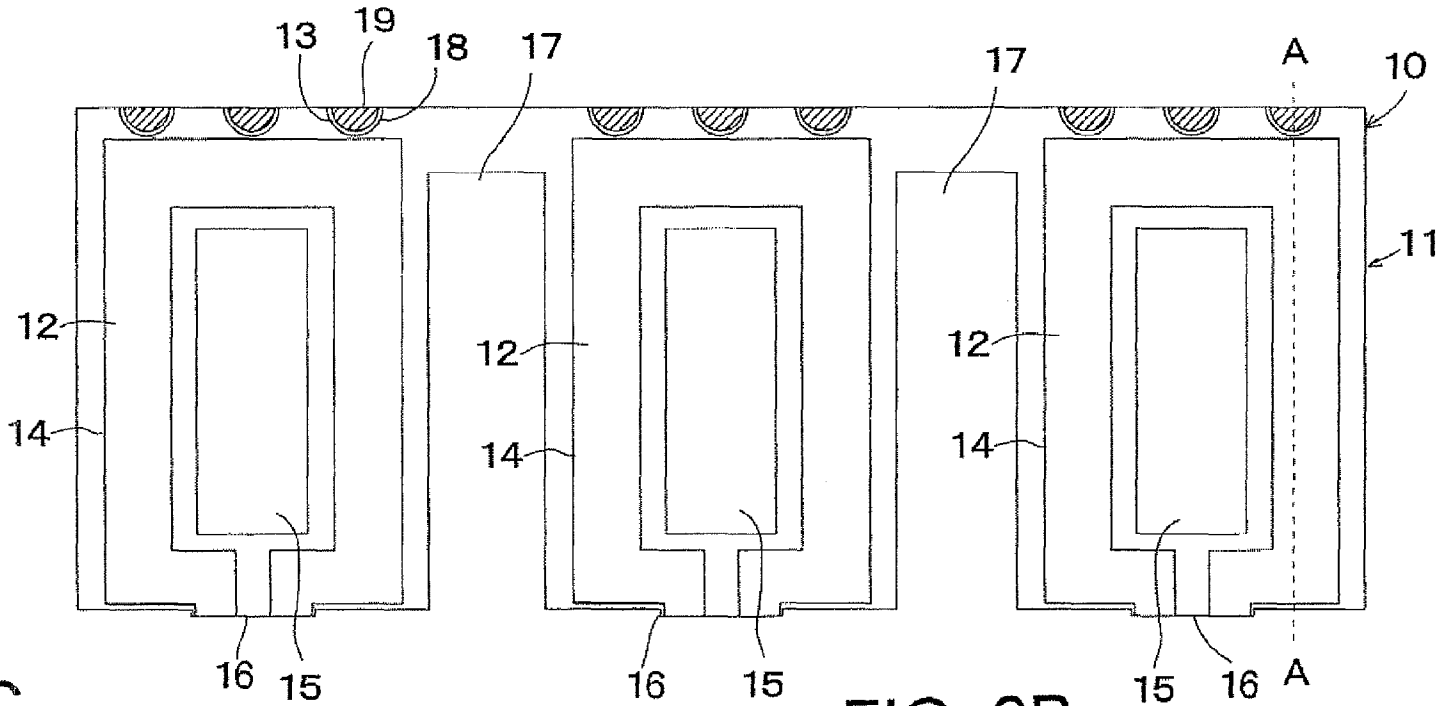
FIG. 6B shows a elevation view of the same and FIG. 6C shows a cross-sectional view along line A-A of the same.
Figure 6C:
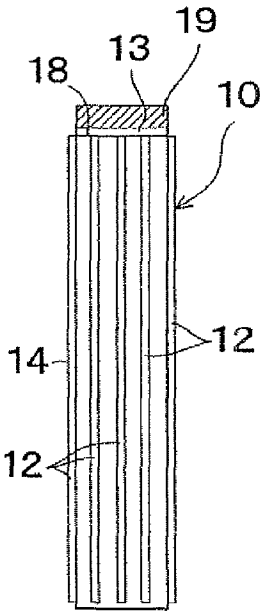

In the same way, the secondary coil board 20 is a multilayer board including conductive round coil patterns 22 (copper patterns etc.) formed respectively on opposite surfaces and intermediate layers (inner layers) of areas (for example, three areas in the drawings) of the multilayer board. As shown in FIG. 5, each extend portion 23 of the coil pattern 22 formed on the intermediate layers is prolonged to a circumference side (upper edge side) of the secondary coil board 20, so that the extend portion 23 is exposed to a groove 28 of the circumference side for cooling. It is preferable that the extend portion 23 spreads out in a whole surface of the groove 28. Alternatively, the extend portion 23 may be partly exposed to the surface of the groove 28 at least as shown in FIG. 7.

Each conductive coil pattern 22 of the front side surface, the intermediate layers and the backside surface in each area of the secondary coil board 20 is connected by throughholes each other so as to make a coil part 24 of one turn or multiple turns around a opening (throughhole) 25. And, the coil parts 24 of all areas are connected in series by the circuit board 60 to make a secondary coil 21 as well as the primary coil 11 shown in FIGS. 6A, 6B and 6C. All grooves 28 are filled with a high thermal conductive resin 29 as a high thermal conductive member to make a flat surface.

The primary and secondary coil boards 10 and 20 respectively have the openings (throughholes) 15 and 25 positioning inside of the conductive coil patterns 12 and 22 in the three areas of the coil parts 14 and 24. Fitting convex portions 16 and 26 are formed on a bottom (under edge side) of the primary and secondary coil boards 10 and 20 respectively.

Figure 4:
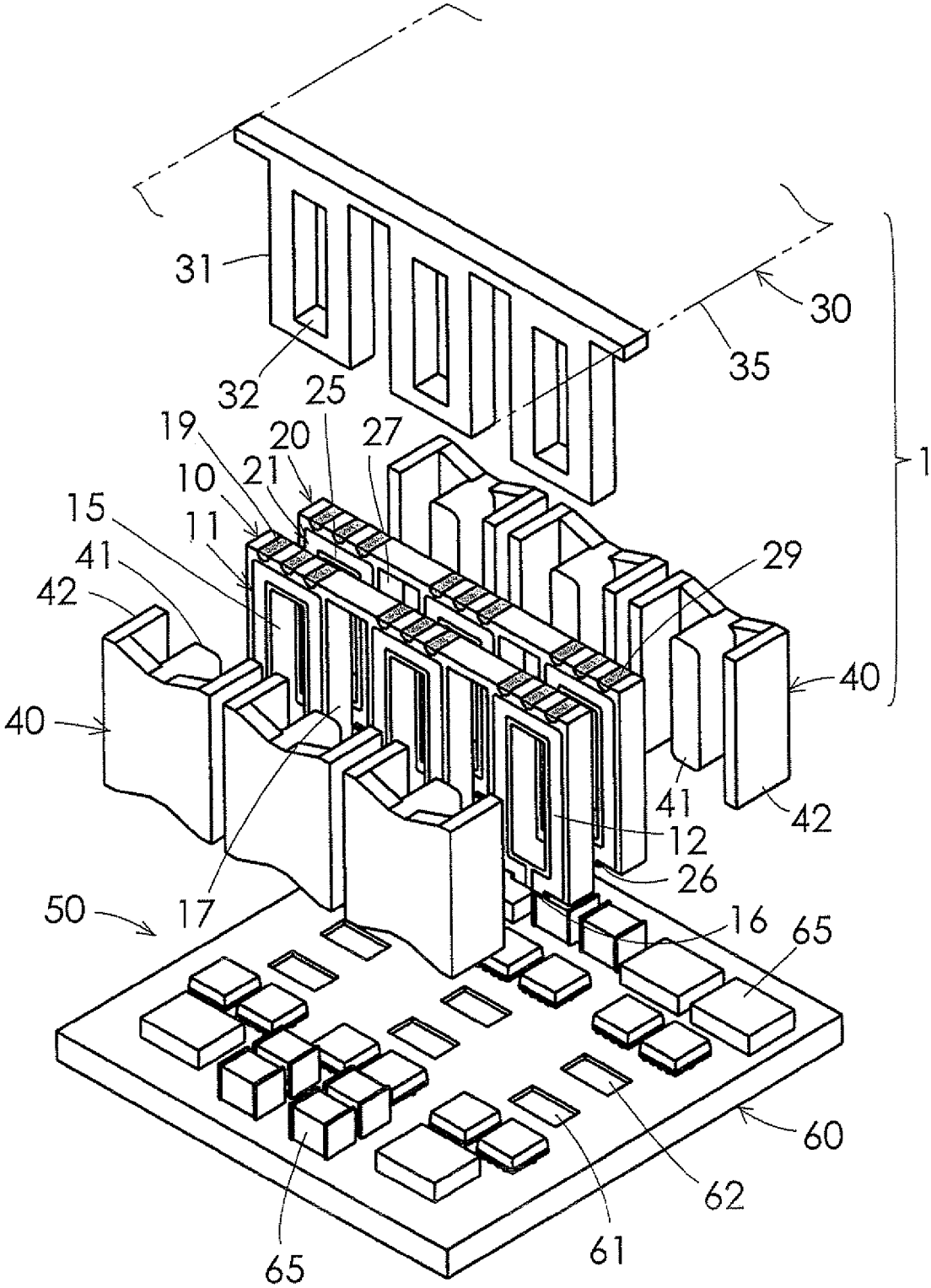
FIG. 4 shows a exploded perspective view of a spacer portion that is a part of a heat sink of the planar transformer, the primary and secondary coil boards, ferrite cores and a circuit board of the switching power supply in the embodiment.

The heat sink 30 have spacer portions 31 inserted into a gap between the primary coil board 10 and the secondary coil board 20 facing each other such that the spacer portions 31 are closely contact with the boards 10 and 20, and a plate-like body 35 integrally formed with the spacer portions 31. The spacer portions 31 droop down perpendicular to an undersurface of the plate-like body 35. As shown in FIG. 4 (the plate-like body is not shown), the spacer portion 31 is formed on three places corresponding to arrangements (three places) of coil parts 14 and 24 of the coil boards 10 and 20, and each spacer portion 31 also has an opening (throughhole) 32 in accordance with the openings 15 and 25 of the coil boards 10 and 20.

Many columnar convexes 36 as cooling convexes are formed on an upper surface outside of the plate-like body 35 to increase a contact area with air for improving a cooling efficiency. There is shown the columnar convexes 36 as cooling convexes, but arbitrarily shaped cooling concaves may be formed.

As for a material of the heat sink 30, high (good) thermal conductive insulators are preferable. For example, high thermal conductive ceramics, resins, mixtures with resins and fillers for increasing thermal conductivity or the like can be used. Also metals of which surface is coated by an electrical insulator can be used. After all, it is necessary that at least the surface of the heat sink 30 is electrical insulation.

A magnetic core assembly includes pairs of ferrite cores 40 as magnetic cores. Each ferrite core 40 is E-shaped core that has a middle leg 41 and both side legs 42, and each pair of ferrite cores 40 is mounted to the primary and secondary coil boards 10 and 20 so as to surround one area of coil parts 14 and 24 thereof Namely, three pairs of cores 40 are used to correspond with three areas of coil parts 14 and 24. The middle legs 41 of a pair of ferrite cores 40 are inserted and located in the openings 15, 25 and 32 of the coil boards 10 and 20 and spacer portion 31. The both side legs 42 of the pair of cores 40 are coupled together to form a closed magnetic pass and bonded and fixed each other. Further, cutouts 17 and 27 are provided in the coil boards 10 and 20 for passing through the both side legs 42.

A circuit board 60 has perforations 61 and 62 as setting holes for positioning the primary coil board 10 and the secondary coil board 20, so that fitting convex portions 16 and 26 of the primary and secondary coil boards 10 and 20 are fitted to the perforations 61 and 62 respectively.

Next, the whole structure of the planar transformer 1 and the DC-DC converter 50 including the circuit board 60 on which the planar transformer 1 is mounted are explained in accordance with the assembling process.

Figure 3:
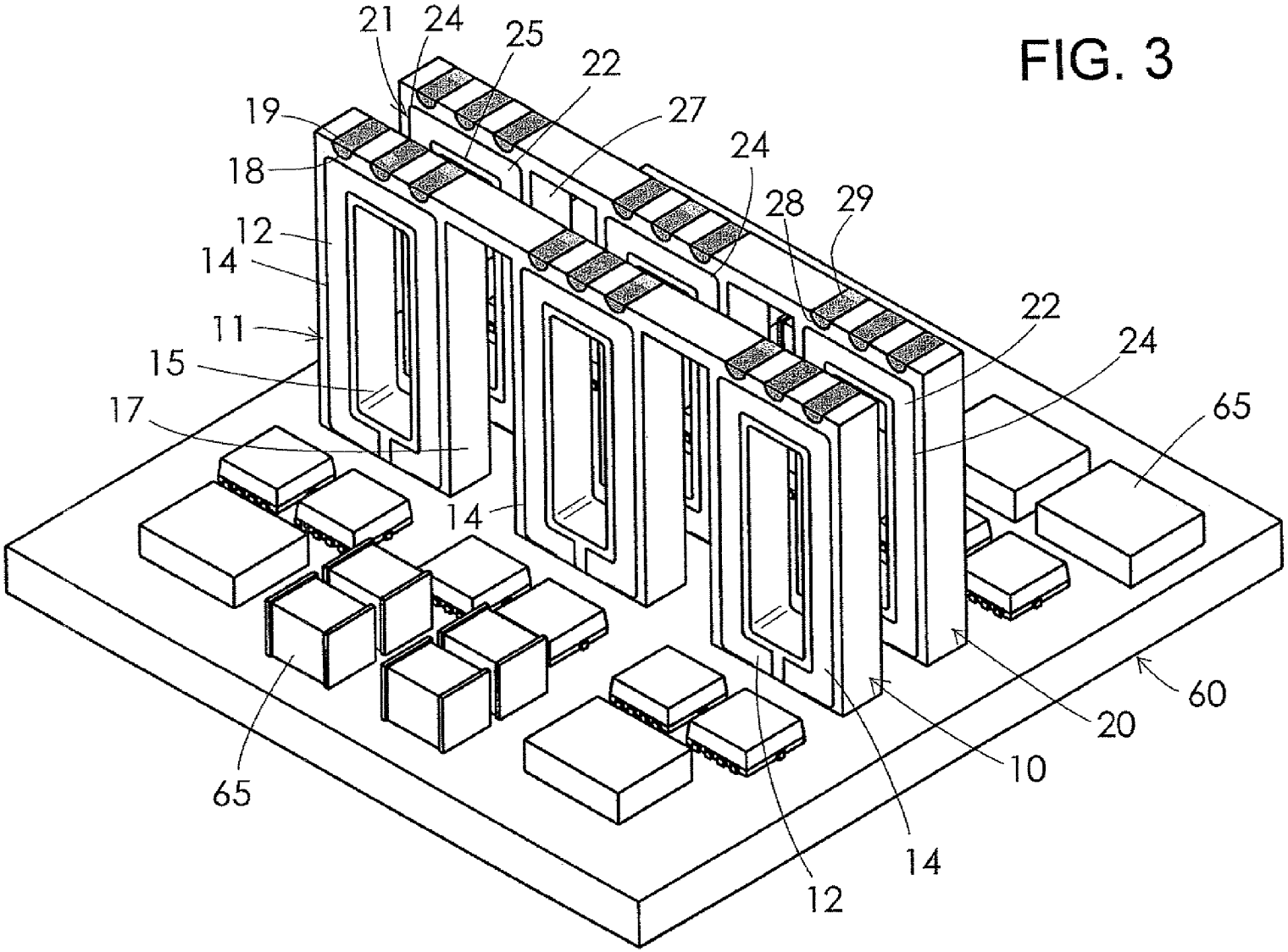
FIG. 3 shows a perspective view of a structure in which primary and secondary coil boards of the planar transformer are mounted on a circuit board of the switching power supply in the embodiment.

First, the fitting convex portions 16 and 26 of the primary and secondary coil boards 10 and 20 are engaged in the perforations 61 and 62 of the circuit board 60 respectively, and if necessary each of boards 10 and 20 is bonded and fixed with the circuit board 60 as shown in FIG. 3. In this condition, electrical connections between parts 65 and the coil boards 10 and 20 mounted on the circuit board 60 are completed by soldering and so on.

And then, the spacer portions 31 of the heat sink 30 as shown in FIG. 4 are inserted into the gap between the primary coil board 10 and the secondary coil board 20, so that the spacer portions 31 are in close contact with facing surfaces of the primary and secondary coil boards 10 and 20. It was described in FIG. 5 and FIG. 6 that the extend portions 13 and 23 of the conductive coil patterns 12 and 22 including intermediate layers of the coil parts 14 and 24 are exposed to the grooves 18 and 28 of the circumference side (upper edge side) of the coil boards 10 and 20, and all grooves 18 and 28 are respectively filled with the high thermal conductive resins 19 and 29 as high thermal conductive members to make the flat surfaces. The plate-like body 35 of the heat sink 30 contacts with the flat surfaces of the high thermal conductive resins 19 and 29 so that heat generations caused by the conductive coil patterns 12 and 22 of the intermediate layers can be cooled by heat transports.

After then, three pairs of ferrite cores 40 are mounted to three areas of the coil parts 14 and 24 of the coil boards 10 and 20. Namely, the middle legs 41 of each pair of cores 40 are inserted into the openings 15, 25 and 32 of the coil boards 10 and 20 and the spacer portion 31, and the both side legs 42 of each pair of cores 40 are coupled together to form a closed magnetic pass and bonded and fixed each other.

Figure 2:
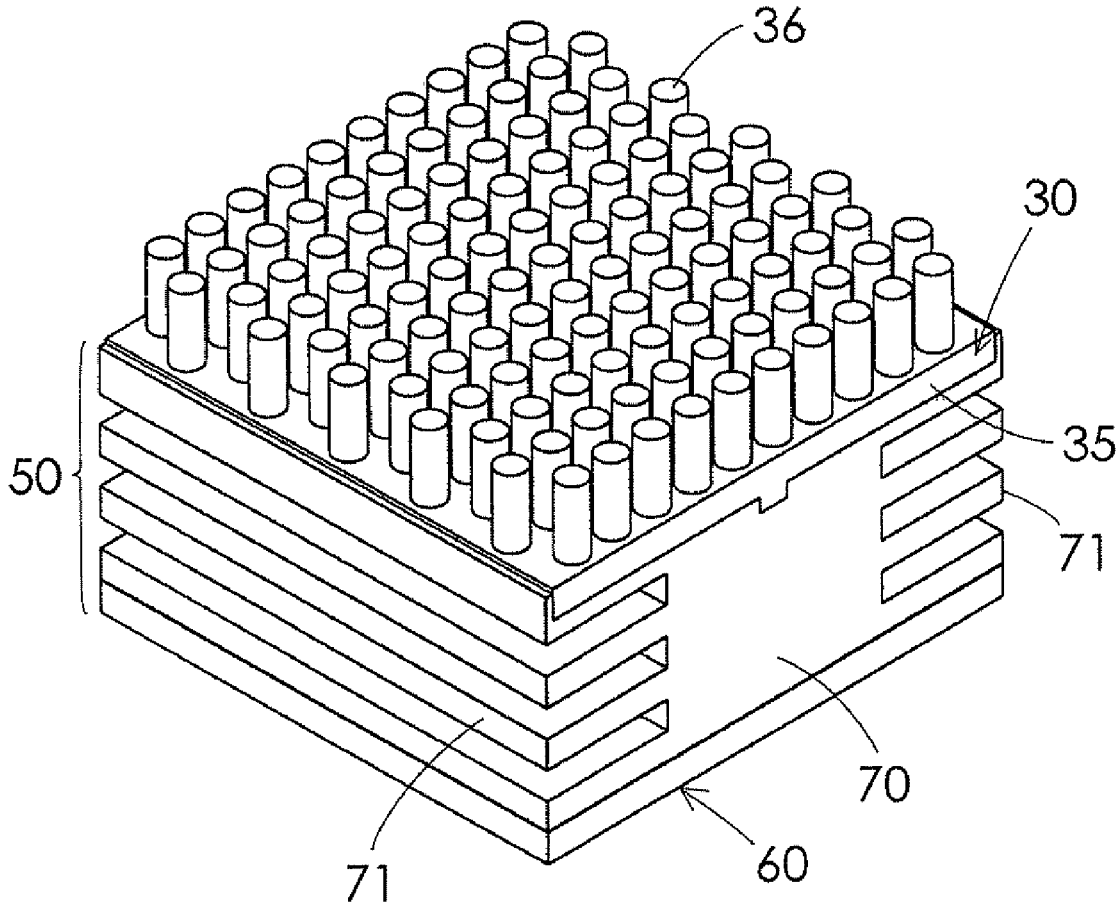
FIG. 2 shows a perspective view of the same.

As shown in FIG. 2, an interspace between an upper surface of the circuit board 60 and an under surface of the body 35 of the heat sink 30 is filled with a mold resin body 70 by mold forming after the coil boards 10 and 20, the heat sink 30, and ferrite cores 40 are mounted on the circuit board 60. The mold resin body 70 is made of a high (good) thermal conductive resin, a resin containing filler for increasing thermal conductivity or the like. And, many cooling fins 71 as cooling convexes or concaves are formed on an outer surface of the mold resin body 70. In addition, the spacer portions 31 have been inserted into the gap between the primary coil board 10 and the secondary coil board 20, and a length of the gap is defined by a thickness of the spacer portion 31. Therefore, the gap is kept to be constant and it doesn't arise inconvenience such that large changing of the gap is caused by mold forming of the mold resin body 70.

According to the embodiment following effects are obtained.

(1) There is a problem of heat generations induced by eddy current losses of the primary and secondary coils 11 and 21 accompanied with increase of switching frequency in the DC-DC converter 50 used for a switching power supply. Therefore, in the embodiment, the primary coil 11 and the secondary coil 21 are made of respective coil boards (i.e. the primary coil board 10 and the secondary coil board 20). The embodiment focuses necessity of a proper gap between the primary coil board 10 and the secondary coil board 20 to satisfy conditions of a leakage inductance, a coupling coefficient etc., thus, the spacer portions 31 integrally formed to the heat sink 30 can be inserted into the gap. The primary and secondary coils 11 and 21 themselves can be directly cooled because the spacer portions 31 are closely contact with the primary coil board 10 and the secondary coil board 20 and lie between the boards 10 and 20. Namely, heat generations of the primary and secondary coil boards 10 and 20 are transported from spacer portions 31 to the body 35, and radiated from outer surface having many columnar convexes 36 of the body 35 to the air.

(2) The conductive coil patterns 12 and 22 formed on intermediate layers of the primary and secondary coil board 10 and 20 respectively have the extend portions 13 and 23 exposed to the circumference side (upper edge side) of the coil boards 10 and 20, and the extend portions 13 and 23 contact the body 35 of the heat sink 30 through the high thermal conductive resins 19 and 29. Therefore, heat generations of the conductive coil patterns 12 and 22 of the intermediate layers are effectively radiated and cooled.

(3) When manufacturing of the DC-DC converter 50 as the switching power supply is accomplished, it can be ensured cooling of ferrite cores 40 and parts 65 mounted on the circuit board 60 because the interspace between the upper surface of the circuit board 60 and the under surface of the body 35 of the heat sink 30 is filled with a mold resin body 70 by mold forming and many cooling fins 71 are formed on the outer surface of the mold resin body 70.

(4) Therefore, high cooling radiation characteristics are realized in relation to all structures of the switching power supply, and downsizing of the switching power supply can be accomplished.

In addition, it may be also preferable structure of the embodiment wherein the extend portions 13 and 23 of the conductive coil patterns 12 and 22 (including those of intermediate layers) of the coil boards 10 and 20 contact directly with the plate-like body 35 of the heat sink 30 for cooling.

Although the embodiment of the present invention has been described above, the present invention is not limited thereto and it will be self-evident to those skilled in the art that various modifications and changes may be made without departing from the scope of claims.

According to the present invention, the spacer portion of the heat sink is inserted into the gap between the primary coil board including the primary coil and the secondary coil board including the secondary coil, so that heat generations caused by eddy currents etc. of the primary and secondary coils are transported from spacer portion to the outer side of the heat sink. As a result, it can be ensured that the heat resistance is decreased, and consequently, it is capable of effective cooling radiation of the primary and secondary coils.

According to the above structure, downsizing of the planar transformer can be realized, and consequently it is capable of decreasing size and thickness of the switching power supply including the circuit board and the planar transformer mounted thereon.

What is claimed is:

1. A planar transformer comprising:

a primary coil board including a primary coil;

a secondary coil board including a secondary coil, the secondary coil board facing and being separated from the primary coil board by a gap;

a heat sink having a surface and that is electrically insulating, at least at the surface, the heat sink including, integrally, a generally planar body and a spacer portion lying in a plane substantially perpendicular to the body, the spacer portion being located in the gap between the primary coil board and the secondary coil board; and a magnetic core assembly mounted to the primary coil board and the secondary coil board, wherein the primary coil board and the secondary coil board include respective multilayer boards comprising outer conductive coil patterns on opposite outside surfaces and at least one inner layer between the outer coil patterns, and respective extended portions extending the outer conductive coil patterns to respective side surfaces of the primary coil board and the secondary coil board, respectively, the extended portions being exposed at the side surfaces of the primary coil board and the secondary coil board, the extended portions thermally contacting the surface of the heat sink, the side surfaces of the primary coil board and the secondary coil board being substantially perpendicular to the spacer portion of the heat sink, and the spacer portion is in contact with the primary coil board and the secondary coil board.

2. The planar transformer according to claim 1, wherein the primary coil board and the secondary coil board respectively have openings inside of the outer conductive coil patterns, and the magnetic core assembly includes a middle leg disposed in the openings.

3. The planar transformer according to claim 1, wherein the body of the heat sink includes a plurality of cooling convexities or cooling concavities on a second surface of the body of the heat sink.

4. The planar transformer according to claim 1, including respective inner conductive coil patterns on the inner layers of the multilayer boards and extending to the respective extended portions.

5. A switching power supply comprising:

a circuit board; and a planar transformer mounted on the circuit board, wherein the planar transformer comprises a primary coil board including a primary coil, a secondary coil board including a secondary coil, the secondary coil board facing and being separated from the primary coil board by a gap, a heat sink having a surface and that is electrically insulating, at least at the surface, the heat sink including, integrally, a generally planar body and a spacer portion lying in a plane substantially perpendicular to the body, the spacer portion being located in the gap between the primary coil board and the secondary coil board, and a magnetic core assembly mounted to the primary coil board and the secondary coil board, wherein the primary coil board and the secondary coil board include respective multilayer boards comprising outer conductive coil patterns on opposite outside surfaces and at least one inner layer between the outer coil patterns, and respective extended portions extending the outer conductive coil patterns to respective side surfaces of the primary coil board and the secondary coil board, respectively, the extended portions being exposed at the side surfaces of the primary coil board and the secondary coil board, the extended portions thermally contacting the surface of the heat sink, the side surfaces of the primary coil board and the secondary coil board being substantially perpendicular to the spacer portion of the heat sink, and the spacer portion is in contact with the primary coil board and the secondary coil board.

6. The switching power supply according to claim 5, wherein the circuit board includes respective setting holes positioning the primary coil board and the secondary coil board on the circuit board, and the primary coil board and the secondary coil board include respective convex portions disposed in the respective setting holes.

7. The switching power supply according to claim 5, including a molded resin uniting the circuit board and the planar transformer.

8. The switching power supply according to claim 7, wherein the molded resin body has a plurality of cooling convexities or cooling concavities on an outer surface of the resin body.

9. The switching power supply according to claim 5, including respective inner conductive coil patterns on the inner layers of the multilayer boards and extending to the respective extended portions.

* * * * *